United States Patent [19]

Wilson

[11] Patent Number: 4,768,784

[45] Date of Patent: Sep. 6, 1988

[54] STRIKE ZONE PITCHING AID

[76] Inventor: Ted L. Wilson, 224 Heather La., Everman, Tex. 76140

[21] Appl. No.: 21,204

[22] Filed: Mar. 3, 1987

[51] Int. Cl.[4] ..... A63B 69/40

[52] U.S. Cl. ..... 273/26 A

[58] Field of Search ..... 273/26 A, 29 A, 181 F; 272/85, 89, 92; 297/274, 276, 275, 277, 278, 281, 287, 279, 280

[56] References Cited

U.S. PATENT DOCUMENTS

| | | | |
|---|---|---|---|
| 1,043,308 | 11/1912 | Everson | 273/26 |
| 1,592,005 | 7/1926 | Rovane | 273/26 A |
| 2,126,102 | 8/1938 | Fowler | 273/26 A |
| 3,583,703 | 6/1971 | Brown et al. | 273/26 |
| 3,997,158 | 12/1976 | Britton | 273/26 |
| 4,068,846 | 1/1978 | Forrest | 273/181 F |
| 4,083,559 | 4/1978 | Owen, Jr. | 273/26 A |
| 4,210,326 | 7/1980 | Booth et al. | 273/26 |
| 4,254,952 | 3/1981 | Playter, Jr. | 273/26 |
| 4,473,227 | 9/1984 | Klaus | 273/26 A |

*Primary Examiner*—Richard C. Pinkham
*Assistant Examiner*—T. Brown
*Attorney, Agent, or Firm*—Charles D. Gunter, Jr.

[57] ABSTRACT

A pitching aid is shown which includes a backstop having sides which define an open interior with a front facing opening. A target is suspended from the backstop within the open interior to define a three dimensional strike-zone. The target has a rigid top and a rigid bottom suspended from the rigid top by flexible sides. Flexible cables connect the rigid bottom to the backstop to suspend the target in tension within the open interior.

7 Claims, 2 Drawing Sheets

STRIKE ZONE PITCHING AID

BACKGROUND OF THE INVENTION

1. Field of the Invention

This invention relates to a strike-zone target which is erectable upon a playing surface for training a pitcher to pitch a ball.

2. Description of the Prior Art

In order to provide an adequate target for a pitcher, such as a baseball pitcher, a catcher usually works with the pitcher. However, this requires the user of one catcher for one pitcher. The utilization of a catcher results in the expenditure of time that otherwise could be used in other kinds of practice. Also, the target presented by the catcher is limited to the size and specific location of the glove which the catcher holds for the pitcher. In other words, the catcher's mitt comprises the target or aiming point for the pitcher as he works for speed and control, but is only a limited target set within a larger strike zone which the pitcher must work with when actually facing the batter during a game.

Because of these limitations, various types of training devices have been provided to replace the human catcher. U.S. Pat. Nos. 4,083,559; 4,254,952; 4,210,326; 3,583,703; 3,997,185; and 1,043,308 show various of the prior art targets utilized as training devices for pitchers. Each of these prior art references shows a target which is two dimensional in nature. In certain of the prior art designs, the strike-zone is not easily adjustable. In other of the designs, the target is subject is subject to wear and tear because of absorbing the entire force of the thrown ball. None of the above references show a three dimensional target zone which actually simulates the target zone created by the batter during actual play.

The object of the present invention is to provide a three dimensional target erectable upon a playing surface for training a pitcher to pitch a ball which simulates the actual strike-zone in three dimensions.

Another object of the invention is to provide such a device which is easily adjustable to vary the dimensions of the strike-zone.

Another object of the invention is to provide a practice device which is not subject to wear and tear caused by absorbing the full force of the thrown ball, which is resilient in nature, and which returns to the same spot after each pitch.

SUMMARY OF THE INVENTION

The device of the invention is erectable upon a plyaing surface for training a pitcher to pitch a ball. The device includes a backstop having sides which define an open interior with a front facing opening. A target is suspended from the backstop within the open interior to define a three dimensional strike-zone. The target has a rigid top and a rigid bottom suspended from the rigid top by flexible sides. The rigid top and rigid bottom each comprise polygonally-shaped structures which are suspended within the open interior generally parallel to the plane of the playing surface. Connecting means run from the rigid bottom to the backstop to suspend the target in tension within the open interior.

Preferably, the polygonally-shaped top and bottom of the target each have opposing sides which define included corners, selected ones of the corners being provided with eyelets. The back stop includes a plurality of legs, each of these legs having a proximate end which comes together at a common header and a distal end.

The target is suspended from the common header within the open interior of the backstop. A spring tensioner connects with the common header and the rigid top of the target. A plurality of flexible cables run from the eyelets in the rigid top, through the eyelets in the rigid bottom, to selected ones of the distal ends of the backstop legs for supporting the target in tension within the open interior.

Additional objects, features and advantages will be apparent in the written description which follows.

DESCRIPTION OF THE PREFERRED EMBODIMENT

Figure 1:
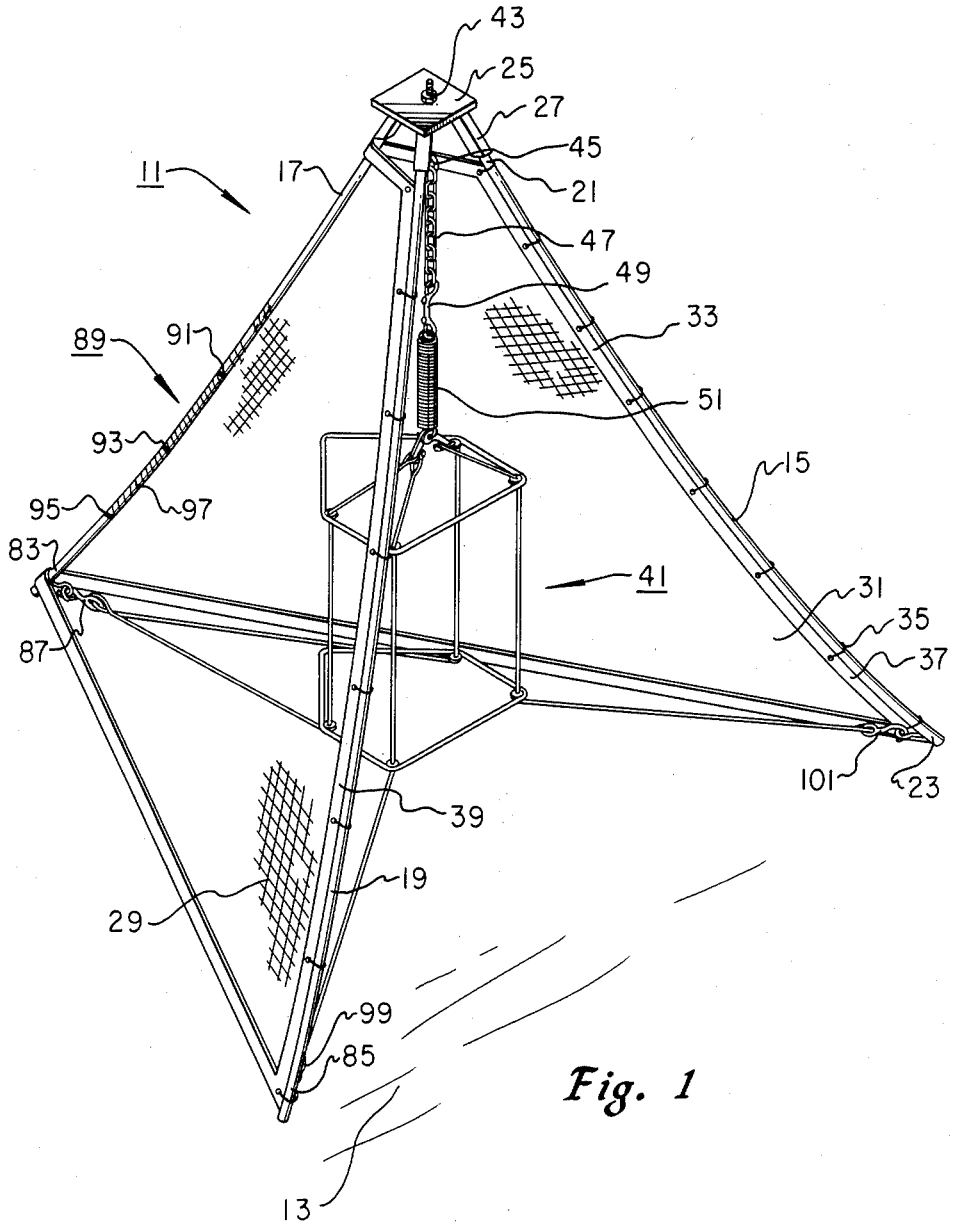
FIG. 1 is a front perspective view of device of the invention erected upon a playing surface.

FIG. 1 shows the device of the invention designated generally a 11. The device 11 is erectable upon a playing surface 13 for training a pitcher to pitch a ball. The device includes a backstop having a plurality of legs 15, 17, 19. Preferably, the backstop is a tripod having three legs, each of the legs having a proximate end 21 and a distal end 23. The proximate ends 21 come together in a common header 25. The header 25 is a flat pate having depending sleeves 27 for receiving the proximate ends 21 of the legs.

A net 29 surrounds a portion of the backstop to define an open interior 31 with a front facing opening 33. As shown in FIG. 1, the tripod center leg 17 is positioned in the center of the surrounding net 29 and the opposing legs 15, 19 are provided with ring clips 35 for engaging the end flaps 37, 39 of the net 29.

Figure 2:
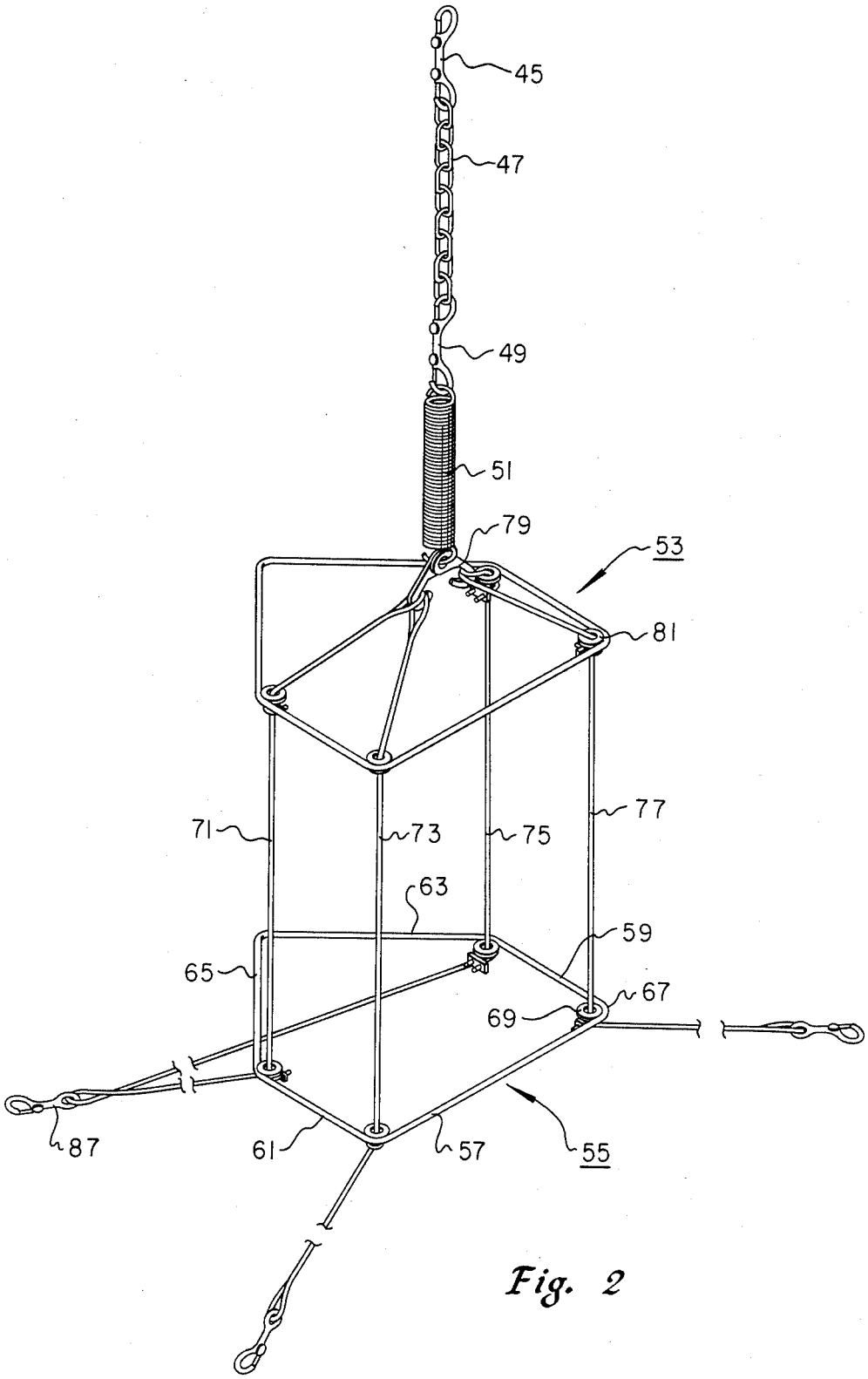
FIG. 2 is an isolated view of the target utilized in the device of FIG. 1.

A target 41 is suspended from the backstop within the open interior 31 to define a three dimensional strike-zone. The common header 25 has an eyebolt 43 from which the target 41 is suspended by means of a spring tensioner. The spring tensioner includes a top clip 45, a link chain 47, a bottom clip 49 and a coil spring 51. As shown in FIG. 2, the target has a rigid top 53 and a rigid bottom 55 suspended from the rigid top by flexible sides. The rigid top 53 and rigid bottom 55 each comprise polygonally-shaped structures which are suspended within the open interior 31 generally parallel to the plane of the playing surface 13. Preferably, the polygonally-shaped structures are pentagons formed in the shape of home plate. That is, the structures have five sides and five angles.

Each of the rigid top and bottom 53, 55 have opposing sids 57, 59, 61, 63 and 65 which define included corners, (i.e., corner 67), selected ones of the corners being provided with eyelets 69. A plurality of flexible cables 71, 73, 75 and 77 run from a hook 79 at the end of the coil spring 51 through the eyelets 81 of the rigid top, through the eyelets 69 in the rigid bottom and to selected ones of the distal ends 23, 83, 85 of the backstop legs for supporting the target 41 in tension within the open interior.

The flexible cables are connected to the distal ends 23, 83, 85 by means of adjustment clamps 87, the vertical size of the target 41 being adjustable by changing the length of cable at the adjustment clamps. The position of the target 41 within the open interior 31 can be adjusted by changing the position of the bottom clip 49 on the link chain 47. When properly adjusted, the center leg 17 of the backstop is generally aligned with the suspended target 41 as viewed through the front facing opening 33. The center leg 17 is also preferably provided with a colored portion 89 which serves as an additional target zone. For instance, the leg 17 can have black bands 91, 93, 95 with the intermediate zones 97 colored orange.

The device 11 is assembled as follows: The three legs 15, 17, 19 are inserted within the sleeves 27 of the common header 25 so that the tripod can stand upright upon the playing surface 13. The top clip 45 is then inserted within the eyebolt 43 of the header 25. Next, the two front adjustment clamps 99, 101 are connected to the distal ends of the legs 15, 19. The rear adjustments clamp 87 is then connected to the distal end 83 of the center leg 17. The front and rear tripod legs are now extended until the target 41 is level and secure. The backstop net 29 can now be secured to the backstop by means of the wing clips 35. The target 41 can be adjusted to difference heights by raising of lowering the position of the bottom clip 49 on the link chain 47. The target can be adjusted for a larger or smaller strike-zones by changing the length of the cable at the adjustment clamps 87, 99, 101.

An invention has been provided with several advantages. The device of the invention makes the strike zone a three dimensional visible object. The device also allows a player to practice without the need of a catcher or a batter. The device is simple in construction and economical to manufacture and can be easily transported to a distant playing area. The target is spring loaded to return to the same position after each pitch, even if the pitch strikes the rigid top or bottom or one of the flexible sides. Because of the resilient nature of the target, the device is not subject to wear and tear due to absorbing the entire force of the throw.

While the invention has been shown in only one of its forms, it is not thus limited but is susceptible to various changes and modifications without departing from the spirit thereof.

I claim:

1. A device erectable upon a playing surface for training a pitcher to pitch a ball, comprising:

a backstop having sides which define an open interior with a front facing opening;

a target suspended from the backstop within the open interior to define a three dimensional strike zone, the target having a rigid top and a rigid bottom suspended from the rigid top by flexible sides, the rigid top and rigid bottom each being a polygonally-shaped structure suspended within the open interior generally parallel to the plane of the playing surface, the polygonally shaped top and bottom of the target each having opposing sides which define included corners, selected ones of the corners being provided with eyelets;

connecting means for connecting the rigid bottom to the backstop whereby the target is suspended in tension within the open interior;and wherein the backstop includes a plurality of legs, each of the legs having a proximate end and a distal end, the proximate ends coming together at a common header, the target being suspended from the common header within the open interior.

2. The device of claim 1, further comprising:

a spring tensioner connecting the common header and the rigid top of the target;and a plurality of flexible cables running from the eyelets in the rigid top through the eyelets in the rigid bottom and to selected ones of the distal ends of the backstop legs for supporting the target in tension within the open interior.

3. A device erectable upon a playing surface for training a pitcher to pitch a ball, comprising:

a backstop having a plurality of legs, each of the legs having a proximate end and a distal end, the proximate ends coming together at a common header;

a net surrounding a portion of the backstop to define an open interior with a front facing opening;

a target suspended from the backstop within the open interior to define a three dimensional strike zone, the target having a rigid top and a rigid bottom suspended from the rigid top by flexible sides, the rigid top and rigid bottom each being a polygonally-shaped structure suspended within the open interior generally parallel to the plane of the playing surface, the polygonally-shaped top and bottom of the target each have opposing sides which define included corners, selected ones of the corners being provided with eyelets;

a spring tensioner connecting the common header and the rigid top of the target;and a plurality of flexible cables running from the eyelets in the rigid top through the eyelets in the rigid bottom and to selected ones of the distal ends of the backstop legs for supporting the target in tension within the open interior.

4. The device of claim 3, wherein the backstop is a tripod having a center leg in the center of the surrounding net and having opposite legs on either side of the center leg, the center leg being generally aligned with the suspended target as viewed through the front facing opening and the center post having a colored portion which serves as an additional target zone.

5. The device of claim 4, wherein the spring tensioner includes a coil spring connected by a clip to a link chain, the height of the target being adjustable by adjusting the position of the clip on the link chain.

6. The device of claim 5, wherein the flexible cables running from the target rigid bottom to the tripod legs are connected to the tripod legs by adjustment clamps, the vertical size of the target being adjustable by changing the length of cable at the adjustment clamps.

7. The device of claim 5, wherein the rigid bottom of the target has a pentagonal shape.

* * * * *